US005486736A

United States Patent [19]

Lee et al.

[11] Patent Number: 5,486,736

[45] Date of Patent: Jan. 23, 1996

[54] DEFLECTION YOKE

[75] Inventors: Gi W. Lee, Suwon; Sung Y. Lim, Seoul; In J. Yoon, Suwon, all of Rep. of Korea

[73] Assignee: Samsung Electro-Mechanics Co., Ltd., Suwon, Rep. of Korea

[21] Appl. No.: 216,131

[22] Filed: Mar. 22, 1994

[51] Int. Cl.[6] ..... H01J 29/70

[52] U.S. Cl. ..... 313/440; 335/213; 335/299; 348/829

[58] Field of Search ..... 313/440; 335/210, 335/213, 214, 296, 299; 348/828, 829

[56] References Cited

U.S. PATENT DOCUMENTS

| | | | |
|---|---|---|---|
| 4,433,268 | 2/1984 | Arisato | 313/440 |
| 4,749,975 | 6/1988 | Tokita et al. | 335/210 |
| 4,882,521 | 11/1989 | Arimoto | 313/440 |
| 5,304,891 | 4/1994 | Otsuka | 313/440 X |

FOREIGN PATENT DOCUMENTS

| | | |
|---|---|---|
| 0034549 | 3/1983 | Japan . |
| 0104544 | 5/1986 | Japan . |

*Primary Examiner*—Sandra L. O'Shea
*Assistant Examiner*—Ashok Patel
*Attorney, Agent, or Firm*—Ladas & Parry

[57] ABSTRACT

A deflection yoke has a non-magnetic conductor on a screen-bent portion or a neck-bent portion of a vertical deflection coil, and the non-magnetic conductor is connected to ground by means of a lead line for the purpose of eliminating a ringing phenomenon caused by stray capacitance between horizontal and vertical deflection coils, and the vertical deflection coil and a ferrite core, which can be adopted to any saddle-saddle type deflection yokes having saddle-shaped vertical and horizontal deflection coils. A considerable amount of the stray capacitance is passed to the ground, and the ringing phenomenon is improved.

2 Claims, 6 Drawing Sheets

FIG.2
PRIOR ART
FIG.2A
FIG.2B
FIG.2C
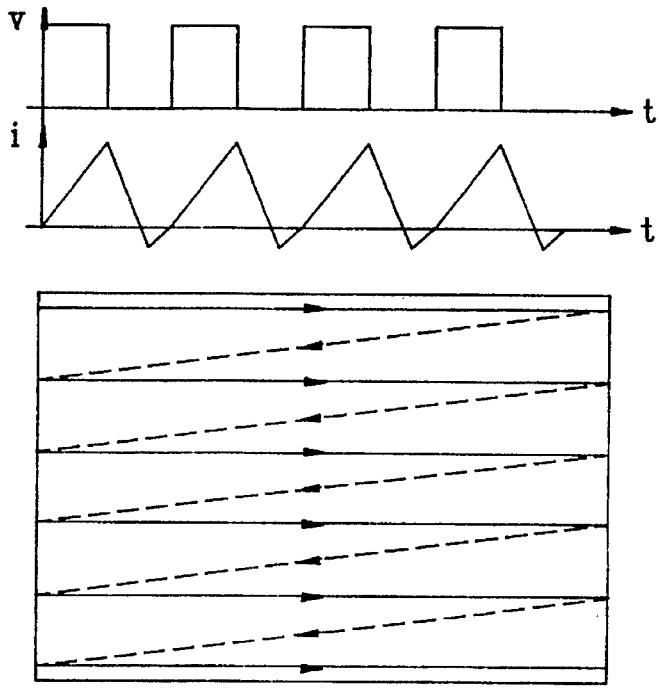
FIG.3
PRIOR ART
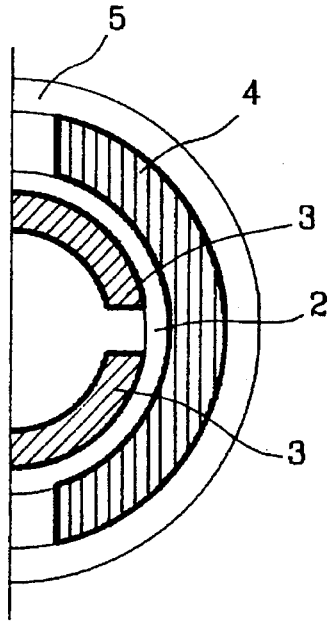

FIG.4
PRIOR ART
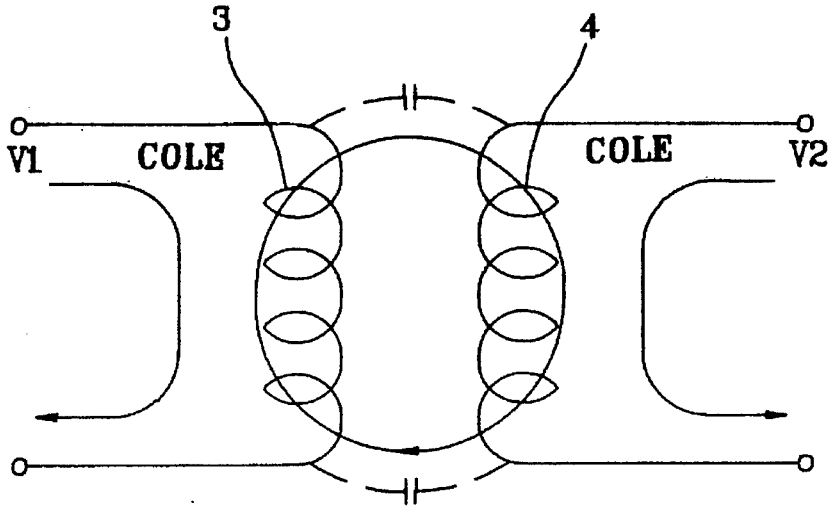
FIG.5
PRIOR ART
FIG.5A
FIG.5B
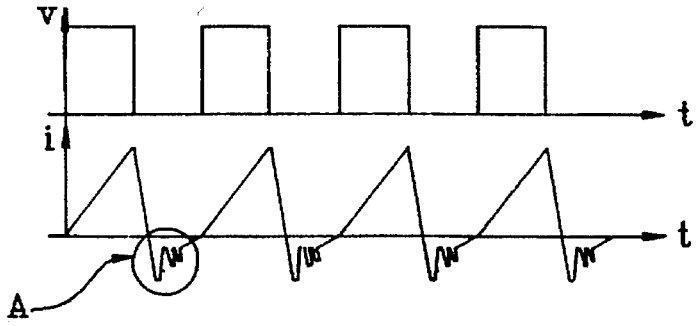
FIG.5C
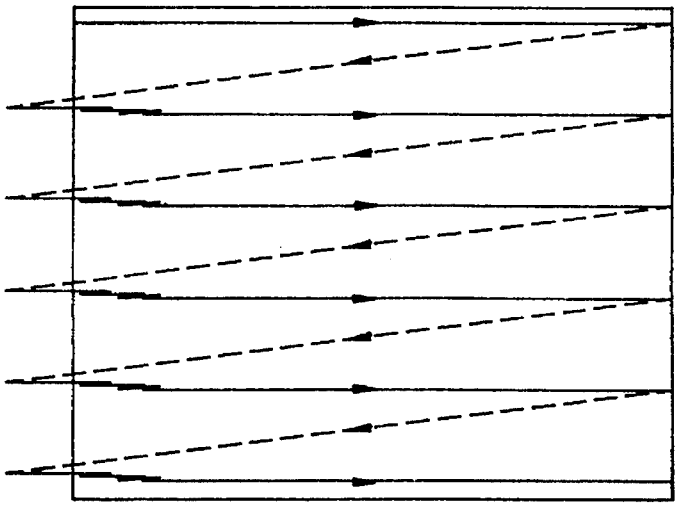

DEFLECTION YOKE

BACKGROUND OF THE INVENTION

1. Field of the Invention

The present invention relates to a deflection yoke, and more particularly to a deflection yoke having a non-magnetic conductor added to a vertical coil (hereinafter simply referred to as "V coil") in order to improve a ringing phenomenon caused by stray capacitance between a horizontal deflection coil (hereinafter simply referred to as "H coil") and V coil and stray capacitance between the V coil and a ferrite core.

2. Description of the Prior Art

Generally, deflection yokes mounted on the rear portion of cathode ray tubes in televisions and monitors are classified into a saddle-saddle type deflection yoke, a saddle-toroidal type deflection yoke, and a bobbin type deflection yoke. Respective deflection yokes include V coils for deflecting electron beams in the vertical direction of a screen, H coils for deflecting the electron beams in the horizontal direction of the screen, a coil separator for determining the structure of the deflection yoke, and magnetic members, i.e., ferrite cores, for increasing the deflection force.

The general structure of the deflection yoke will be described with reference to FIG. 1. As illustrated in FIG. 1, a deflection yoke 1 is provided with a pair of front screen-bent and rear neck-bent saddle-shaped H coils 3 on the inner side of a coil separator 2 in the up and down direction, using a horizontal axis of the deflection yoke 1 as a reference. Using the horizontal axis of the deflection yoke as a reference, a pair of front screen-bent and rear neck-bent saddle-shaped V coils 4 are mounted on the outer side of the coil separator 2 in the left to right direction. A pair of ferrite cores 5 are installed to surround the V coils 4. The ferrite cores 5 are fixed by a core clamp (not shown). The deflection yoke 1 having the above-described construction is installed on tile rear portion of a cathode ray tube.

At this time, when the deflection yoke is supplied with a pulse voltage as shown in FIG. 2A, sawtooth current (as shown in FIG. 2B) is supplied to the H coil 3 and V coil 4 of the deflection yoke 1, respectively, so that respective deflection magnetic fields are generated by the H coil 3 and the V coil 4. That is, as shown in FIG. 2C, RGB electron beams scanning while passing through the center portion of the deflection yoke 1 are deflected in horizontal and vertical directions prior to forming a picture by scanning, due to the horizontal and vertical deflection magnetic fields respectively generated by the H coil 3 and V coil 4. Meantime, in the deflection yoke constructed as above, the spacing between the H coil 3 and V coil 4 and that between the V coil 4 and ferrite core 5 are so narrow to cause a magnetic force and an electric force of a predetermined magnitude between the H coil 3 and V coil 4 or the V coil 4 and ferrite core 5.

Here, the generation of the magnetic force is the same as the publicly-known theory of a transformer. In more detail, as illustrated in FIG. 4, once the H coil 3 is supplied with a voltage V1 to flow current, a magnetic field is induced from the B coil 3 to the V coil 4 as much as a predetermined value in accordance with the coiled ratio of the H coil 3 and V coil 4, which can be written as:

$$V = L \times \frac{di}{dt} \quad \text{(equation 1)}$$

where V denotes a voltage and L is an inductance of the coil.

Also, as shown in FIG. 4, since stray capacitance occurs between the H coil 3 and V coil 4, and V coil 4 and ferrite core 5, the electric force is generated. The reason of the occurrence of the stray capacitance is in that the horizontal deflection voltage V1 is much greater than a vertical deflection voltage V2 to cause two voltage differences. In other words, while the horizontal deflection voltage V1 has a range of −20 to 1000 [V], the vertical deflection voltage V2 has a range of 0 to 20 [V]. Therefore, the voltage difference between the two voltages is so great that a predetermined amount of electric charge exists between the two coils 3 and 4 which is the same as the theory of a capacitor, which can be defined as below:

$$Q = C \times V \quad \text{(equation 2)}$$

where Q denotes an amount of the electric charge, C is the capacitance, and V is the voltage.

Also, in the H coil 3 and V coil 4, since respective coils 3 and 4 are adjacently installed to induce the stray capacitance having the electric force with respect to coils 3 and 4. The stray capacitance inconsistently distributed throughout the H coil 3 or V coil 4 affect the sawtooth current supplied to the H coil 3 and the V coil 4.

When the magnetic force and electric force affect the sawtooth current supplied to the H coil 3 and V coil 4, an irregular waveform A as shown in FIG. 5B is generated to make the electron beams irregularly scan the left portion of the screen as shown in FIG. 5C, thereby causing black and white stripes. This is called as a ringing phenomenon.

A conventional technique for improving the ringing phenomenon will be described with reference to Japanese Patent Laid-open Publication No. sho 58-34549.

As illustrated in FIG. 6, a center tap 6 is drawn out of the center of the V coil 4, and damping resistors 7 and 8 of several k, respectively, are connected between the center tap 6, and a start terminal VS and a final terminal VF.

The deflection yoke constructed as above can damp a resonance phenomenon caused owing to the inherent inductance of the V coil 4 and the stray capacitance existing at the V coil 4, which results in decreasing resonance current in accordance with a pulse voltage, thereby improving the ringing.

However, when coiling the V coil 4 of the deflection yoke 1, a half of the V coil 4 is coiled by running a typical coiling machine, and an operator stops the coiling machine to draw out the end of the coiled V coil 4 and fix the drawn out coil to a link. Thereafter, the coiling machine is operated again to coil remaining half of the V coil 4.

In this case, the process for drawing out the center tap of the V coil is very fastidious, and lengthens working hours.

Moreover, if a coiling machine capable of drawing out the center tap is intended to be employed, the coiling machine should be additionally purchased to require additional cost.

On the other hand, referring to Japanese Patent Laid-open Publication No. sho 61-104544 as shown in FIG. 7, a thin conductive members 9 are respectively adhered on the surfaces of the upper coil and lower coil of the H coil 3, i.e., from the start terminal to the center of the coil.

That is, the conductive members 9 are adhered to the left and right of the upper coil and the left and right of the lower coil one by one, so that one deflection yoke has four conductive members 9.

In the deflection yoke having the above-described structure, since the stray capacitance inconsistently distributed throughout the H coil 3 can be mutually exchanged by means of the conductive members 9, the stray capacitance throughout the H coil 3 can be regularly distributed to improve the ringing.

However, in the above technique, once a voltage is supplied to the H coil attached with the conductive member, the horizontal deflection magnetic field generated by the supplied voltage is induced by the conductive member, and current flows in the direction vertical to the direction of the magnetic field due to the horizontal deflection magnetic field to reduce horizontal deflection current. Thus, a horizontal deflection amplitude is decreased. Furthermore, the current generated by the conductive member heats the conductive member, and the characteristic of the deflection yoke is changed due to the heat.

SUMMARY OF THE INVENTION

The present invention is devised to solve the above-described problems. Accordingly, it is an object of the present invention to provide a deflection yoke for inhibiting the occurrence of ringing, in which non-magnetic conductors are respectively attached to a pair of vertical deflection coils, the non-magnetic conductor is connected to a ground by means of a lead line to pass stray capacitance generated due to a horizontal deflection coil, a vertical deflection coil and a ferrite core to the ground, thereby eliminating the stray capacitance.

To achieve the above object of the present invention, there is provided a deflection yoke which has a coil separator for forming the shape of the deflection yoke, a pair of horizontal deflection coils on the inner side of the coil separator for generating a deflection magnetic field to horizontally deflect electron beams, a pair of vertical deflection coil on the outer side of the coil separator for generating a deflection magnetic field to vertically deflect the electron beams, and ferrite cores of a magnetic material mounted to wrap the outer portion of the vertical deflection coils to increase a deflection force. Here, the deflection yoke includes non-magnetic conductors which are attached to a screen-bent portion of the pair of vertical deflection coils for externally wrapping the respective vertical deflection coils, and allowing stray capacitance generated between the horizontal deflection coil and vertical deflection coil and between the vertical deflection coil and ferrite core to be conducted. Furthermore, lead lines simultaneously connected to the non-magnetic conductors and final terminals at the end of the vertical deflection coils are provided for the deflection yoke for allowing the stray capacitance conducted by the non-magnetic conductor to be passed to ground.

Preferably, the non-magnetic conductor is attached to the screen-bent portion and neck-bent portion of the pair of vertical deflection coils by twos.

BRIEF DESCRIPTION OF THE DRAWINGS

The above objects and other advantages of the present invention will become more apparent by describing in detail preferred embodiments thereof with reference to the attached drawings in which:

FIG. 2A shows a prior art voltage waveform supplied to the horizontal and vertical deflection coils;

FIG. 2B shows a prior art sawtooth waveform supplied to the horizontal and vertical deflection coils;

FIG. 2C shows a prior art state that electron beams scan a screen;

FIG. 3 is a prior art sectional view showing a prior art lower portion of the saddle-saddle type deflection yoke;

FIG. 4 is a prior art equivalent circuit diagram of the deflection yoke shown in FIG. 3;

FIG. 5A shows a prior art voltage waveform supplied to the horizontal and vertical deflection coils;

FIG. 5B shows a prior art sawtooth waveform under the state of appearing the ringing phenomenon;

FIG. 5C shows a prior art state of electron beams scanning a prior art screen by the waveform shown in FIG. 5B;

DETAILED DESCRIPTION OF THE PREFERRED EMBODIMENT

Figure 1:
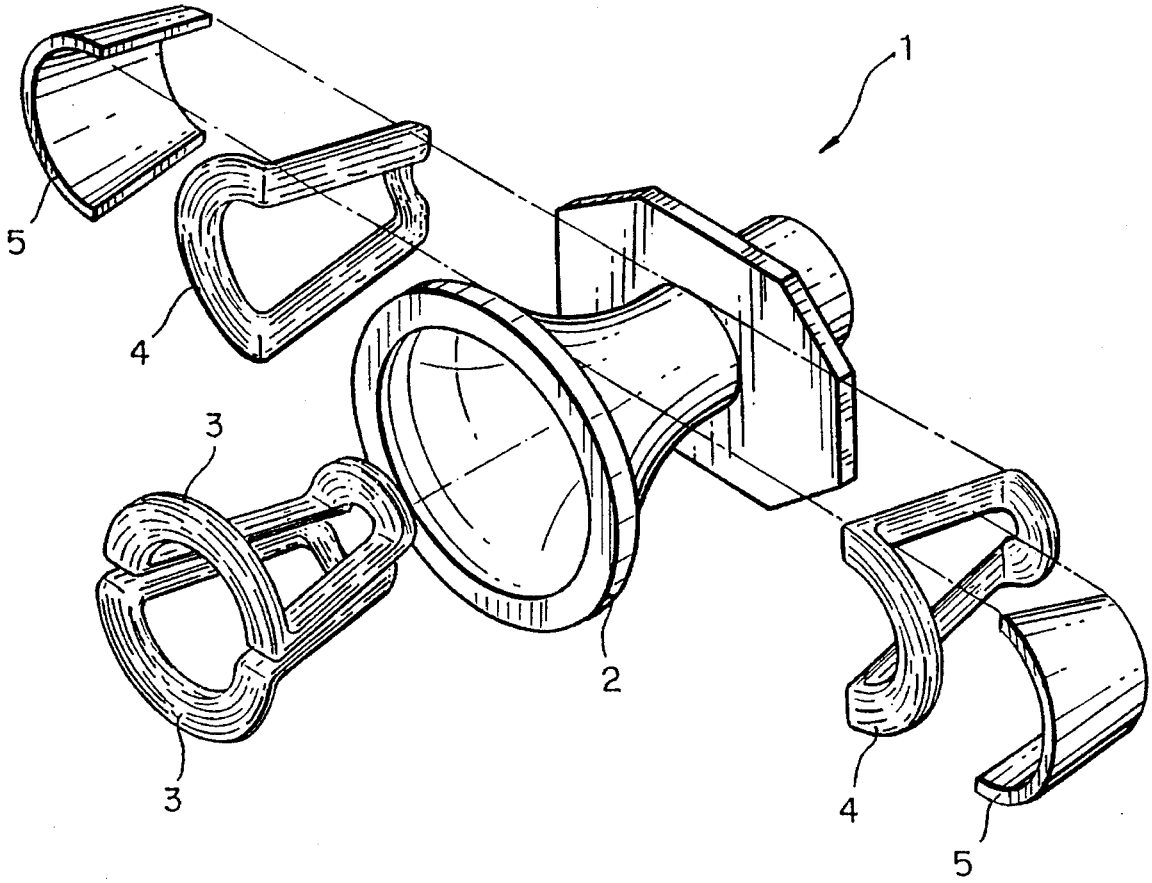
FIG. 1 PRIOR ART
FIG. 1 is an exploded perspective view showing a prior art saddle-saddle type deflection yoke.
Figure 6:
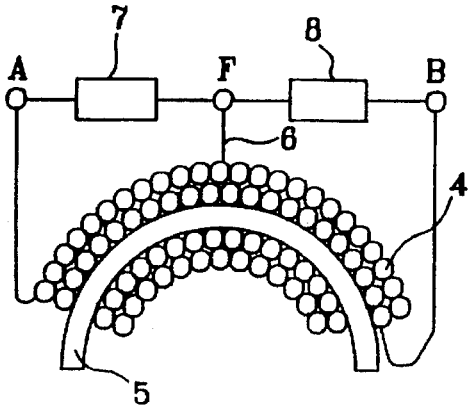
FIG.6 PRIOR ART
FIGS. 6 and 7 are schematic construction views showing prior art deflection yokes contrived for improving the ringing phenomenon.
Figure 7:
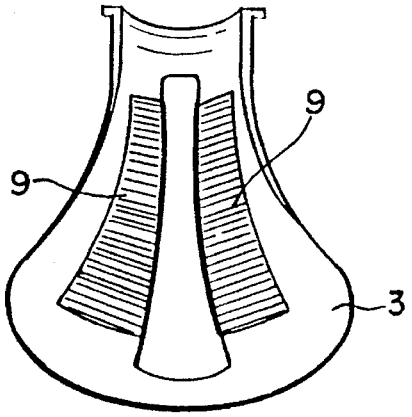
FIG.7 PRIOR ART
Figure 8:
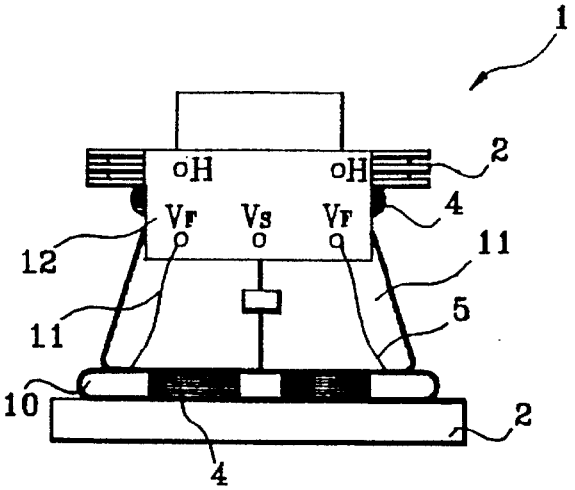
FIG. 8 is a front view showing a deflection yoke according to the present invention.
Figure 9A:
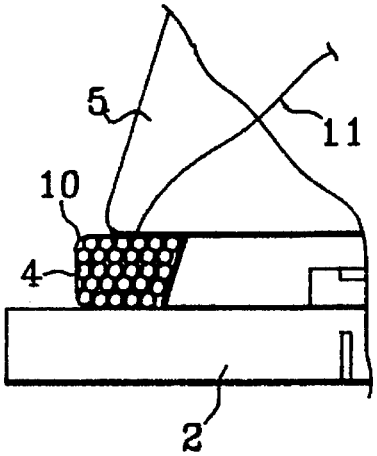
FIGS. 9A and 9B are detailed diagrams showing a portion of the deflection yoke shown in FIG. 8.
Figure 9B:
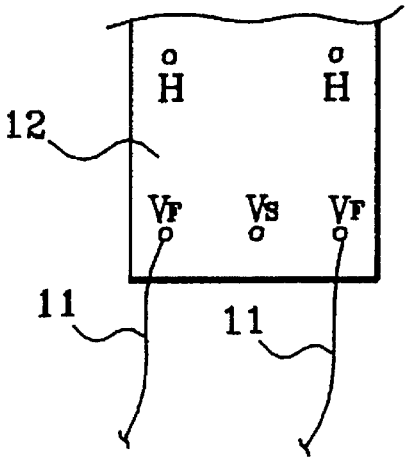

In FIG. 8 showing one embodiment of a deflection yoke according to the present invention, reference numerals described with reference to FIG. 1 designate the same parts in the following description, which thus will be omitted and only the essential parts of the present invention will be described.

As illustrated in FIGS. 8, 9A, 9B, 11 and 12 non-magnetic conductors 10 are attached to the V coils 4 one by one as wrapping a screen-bent portion of the pair of V coils 4. A lead line 11 is connected to the non-magnetic conductor 10, which is then connected to the final terminal VF of the V coil 4 formed on a terminal board 12. Here, the final terminals VF of the V coil 4 correspond to a ground and a yellow terminal of the deflection yoke 1, respectively, and the voltage of this terminal is almost 0 [V], thereby necessarily grounding the non-magnetic conductor 10.

Figure 10:
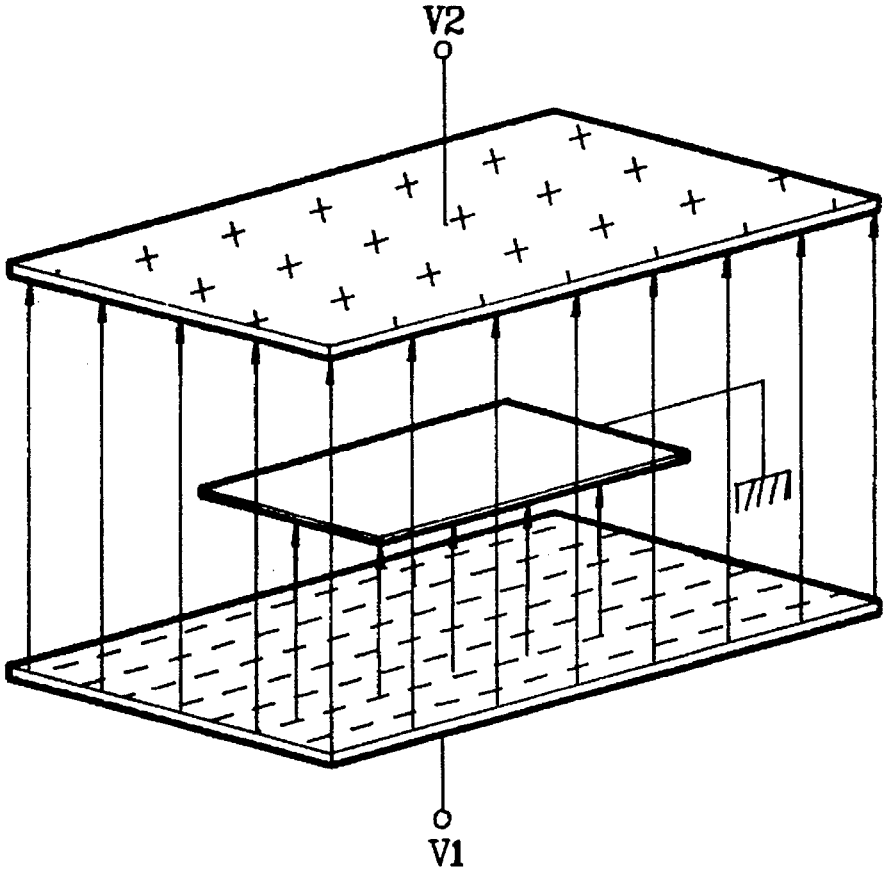
FIG. 10 is a view for illustrating the theory of the deflection yoke shown in FIG. 8.
Figure 12:
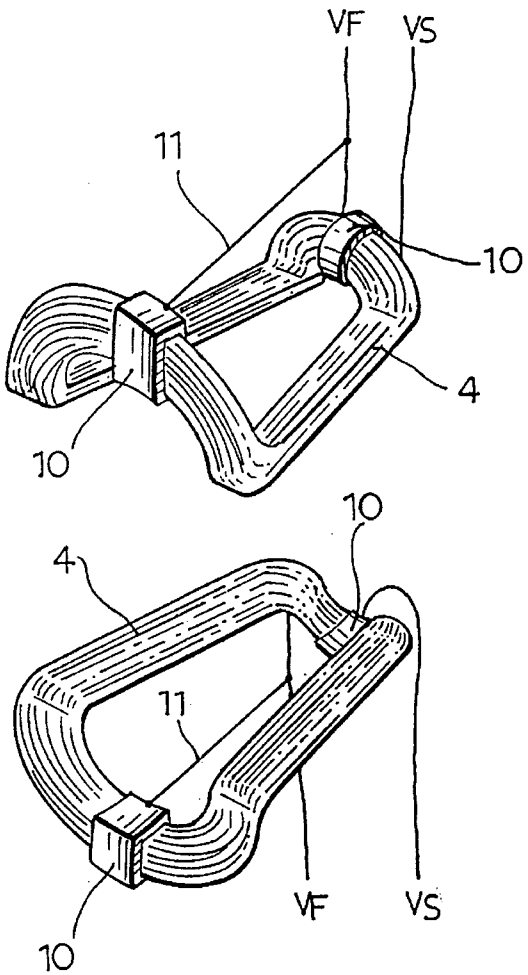
FIGS. 11 and 12 are exploded perspective views of respective coil portions of deflection yokes according to the present invention.
Figure 11:
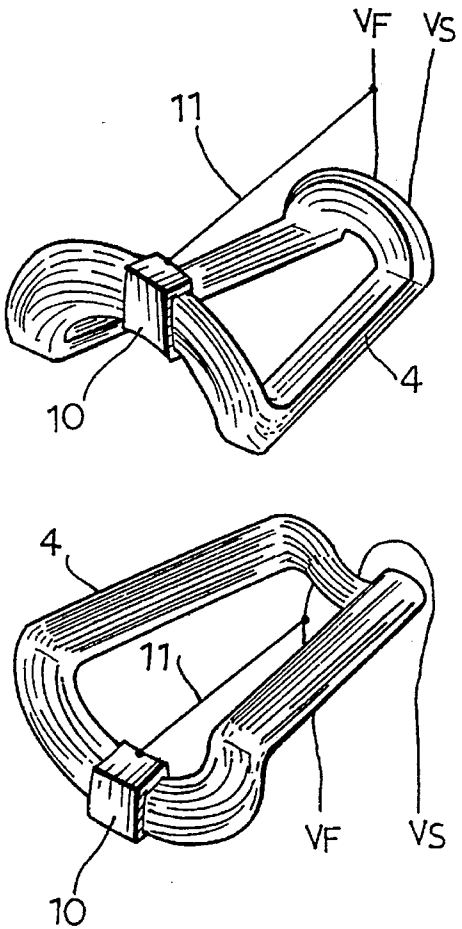

The deflection yoke 1 constructed as above eliminates the stray capacitance in accordance with the theory as illustrated in FIG. 10. That is to say, when the equation 2 is considered to obtain the amount of the electric charge of the stray capacitance, $$C=\frac{Q}{V}=\frac{S}{d} \qquad \text{(equation 3)}$$

where, Q denotes a dielectric constant, S is an area of an inductor, and d is a thickness of the inductor. In other words, since the stray capacitance C displays the relation in proportion to the area S of the inductor, the stray capacitance C can be decreased to be near zero by decreasing the area S of the inductor to be near zero.

As can be noted in the above, the stray capacitance C has a relation to the area S of the inductor (here, such as the H coil 3, V coil 4 and ferrite core 5), so that, once the area S of the inductor is decreased, the stray capacitance C is necessarily decreased. Therefore, in order to decrease the area S of the inductor, the non-magnetic conductor 10 is attached to the V coil 4, and then connected to ground. By doing so, an inductance capacitance corresponding to the size of the non-magnetic conductor 10 in the inductance capacitance appearing between the H coil 3 and V coil 4 and between the V coil 4 and ferrite core 5 is induced by the non-magnetic conductor 10 to be passed to the ground along the non-magnetic conductor 10. Thus, the area of the inductor is reduced as much as the size of the non-magnetic conductor 10. Accordingly, the amount of the stray capacitance C causing the ringing phenomenon is decreased to improve the ringing phenomenon.

Meanwhile, the deflection yoke 1 is provided with the non-magnetic conductor 10 attached to the screen-bent portion or the neck-bent portion which is not directly affected by the horizontal deflection yoke. Therefore, the amplitude is not decreased and the deflection yoke 1 is not overheated by the non-magnetic conductor 10 to enable the deflection yoke 1 to be very stably and efficiently used.

As a result, in the deflection yoke according to the present invention, the non-magnetic conductor is attached on the vertical deflection coil to ground the non-magnetic conductor. Thus, the stray capacitance caused by the adjacently arranged structures of the horizontal and vertical deflection coils or the vertical deflection coil and ferrite core is passed to be grounded, thereby improving the ringing phenomenon.

According to the deflection yoke of the present invention, the non-magnetic conductor is attached to the screen-bent portion or neck-bent portion which is not directly affected by the vertical deflection magnetic field to eliminate a concern about the decrease of the amplitude and overheating of the deflection yoke by means of the non-magnetic conductor.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. In a deflection yoke having a coil separator for forming the shape of said deflection yoke, a pair of horizontal deflection coils on the inner side of said coil separator for generation a deflection magnetic field to horizontally deflect electron beams, a pair of vertical deflection coils on the outer side of said coil separator for generation a deflection magnetic field to vertically deflect said electron beams, each of said vertical deflection coils having a screen-bent portion at its front part and a neck bent portion at its rear part, and a pair of ferrite cores of a magnetic material mounted to wrap the outer portion of said vertical deflection coils to increase a deflection force, improvements to said deflection yoke comprising:

non-magnetic conductors respectively attached to said screen-bent portions of said pair of vertical deflection coils for externally wrapping said vertical deflection coils, and allowing stray capacitance generated between said horizontal deflection coils and vertical deflection coils and between said vertical deflection coils and said pair of ferrite cores to be conducted; and lead lines simultaneously connected to said non-magnetic conductors and terminals at ends of said vertical deflection coils for allowing said stray capacitance conducted by said non-magnetic conductors to be passed to ground.

2. The deflection yoke as claimed in claim 1, wherein said non-magnetic conductors are also respectively attached to said neck-bent portions of said pair of vertical deflection coils.

* * * * *